United States Patent [19]

Harris et al.

[11] 4,206,435

[45] Jun. 3, 1980

[54] TRANSFORMER COVER

[75] Inventors: John O. Harris; Kai Leung, both of London, Canada

[73] Assignee: Northern Telecom Limited, Montreal, Canada

[21] Appl. No.: 947,589

[22] Filed: Oct. 2, 1978

[51] Int. Cl.[2] ..... H01F 27/02

[52] U.S. Cl. ..... 336/65; 174/138 F; 336/90; 336/98

[58] Field of Search ..... 336/90, 92, 98, 65, 336/209, 192, 208, 198; 174/138 F

[56] References Cited

U.S. PATENT DOCUMENTS

| | | | |
|---|---|---|---|
| Re. 28,499 | 7/1975 | Flentge | 336/92 |
| 3,230,490 | 1/1966 | Johnson | 336/92 X |
| 4,028,654 | 6/1977 | Bullard et al. | 336/192 X |
| 4,041,430 | 8/1977 | Hrynewycz | 336/92 |

FOREIGN PATENT DOCUMENTS

| | | | |
|---|---|---|---|
| 1205713 | 2/1960 | France | 336/98 |

*Primary Examiner*—Thomas J. Kozma
*Attorney, Agent, or Firm*—Sidney T. Jelly

[57] ABSTRACT

A shield for protecting transformer wire has a cap which fits over and locates the shield relative to the transformer laminations, a side wall to protectively cover transformer wire wound on a bobbin and an integral flange to protectively cover transformer input and output wire. A deflectable locking piece integral with the side wall is locatable under a flange of the bobbin to lock the shield in place.

8 Claims, 5 Drawing Figures

TRANSFORMER COVER

Many telephone sets contain a circuit board having conducting paths on one face and a host of components, connected into an electrical circuit by the conducting paths, mounted on the board on the opposite face. The components include a transformer characterized, typically, by a pair of overlapping coils of shellac-coated 34 gauge copper wire. Surface turns of the outer transformer coil are normally exposed within the telephone sub-set and, on occasion, have fallen victim to a screw driver during repair or installation. Transformer wire is even more vulnerable where it extends from the coils to outlying terminals since single unsupported filaments of wire may be suspended in mid-air.

We propose a removable shield tailored to fit conventional transformer structures and functioning to prevent damage to the associated transformer wire.

According to one aspect of the invention, for telecommunication apparatus a transformer and shield assembly comprises:

a transformer having coils wound on a bobbin having a central former extending between first and second flanges, electrical input and output wire of said coils passing adjacent said first flange; and a demountable shield having a cap, at least one side extending from said cap to at least partially cover transformer coil wire on said former, and a flange projecting outwardly from said each side to at least partially cover transformer coil input and output wire.

The bobbin flanges and the former can be generally rectangular and the shield can have, for example, two opposed sides extending adjacent opposite sides of the bobbin.

The transformer can further comprise a stack of laminations extending adjacent an outer surface of said flange, said cap being planar and rectangular and having depending walls fitting closely over said laminations.

Each of the shield sides can have an outwardly extending web and a two-part side wall one part of the side wall uniting the web and the flange and the other part of the side wall projecting from, and being spring deflectable relative, the flange.

Each of said other side parts can have a free end formed with an inwardly projecting lug, preferably ramp-shaped. Both the web and the flange of each shield side can be inclined relative to the plane of the cap.

The shield can be moulded in ABS plastic.

We would now refer the reader to the attached pictures in which

Figure 4:
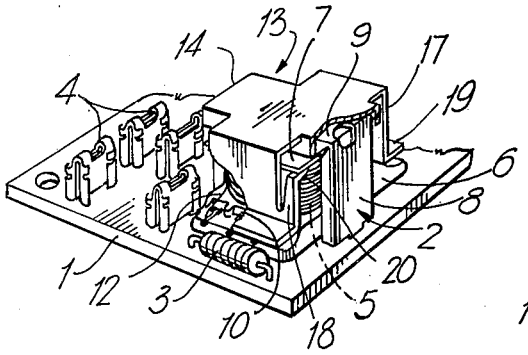
Figure 5:
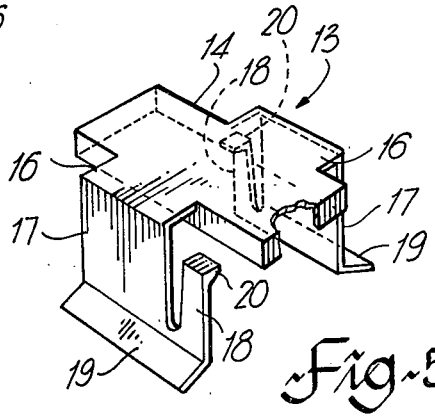
Figure 1:
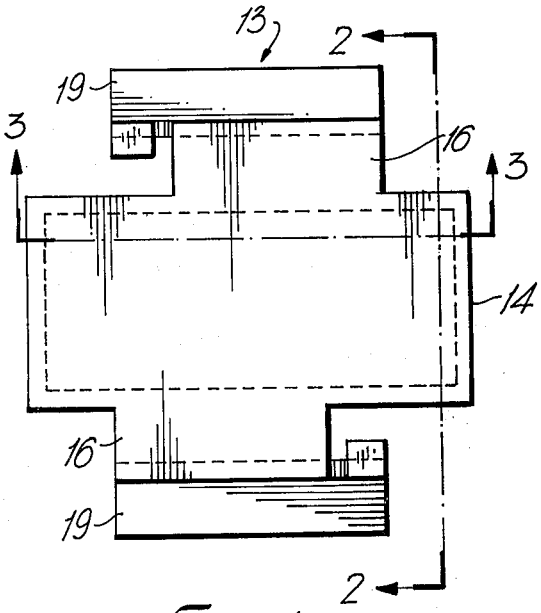
Figure 2:
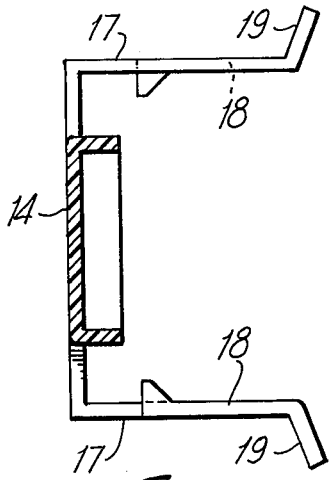
Figure 3:
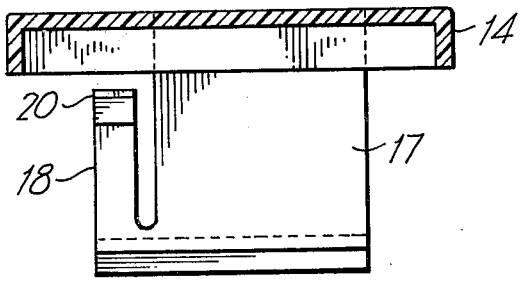

FIGS. 1 to 3 are respectively a plan view, a vertical section and a horizontal section of one embodiment of shield, FIG. 4 is a perspective view of a circuit board supporting a shield-transformer assembly with a part of the shield cut away to illustrate the positional relationship of the shield to the transformer;

and FIG. 5 is a perspective view of the shield with part cut away.

Referring in detail to FIGS. 4 and 5 only, there is shown part of a board 1. On its top surface are mounted electrical components—transformer 2, resistor 3 and terminal posts 4, for example, and on its bottom surface are solder interconnections (not shown) to establish an electrical circuit including the components. The transformer is conventionally formed by winding primary and secondary coils of enamel coated copper wire of 34 gauge onto a bobbin having a central former 5 and outer flanges 6 and 7, the flanges being square. Mounted on the board 1 is a stack of laminations 8 of rectangular configuration; the laminations have a cross span 9 of cuboid form. As can be seen in the drawings input and output lengths 12 of transformer wire extend from the coils to terminals 10 formed at the upper ends of stakes 11 which are connected into the electrical circuit by the solder interconnections.

Demountably mounted on the transformer is a shield 13 moulded in ABS plastics. The shield has a rectangular cap 14 dimensioned to fit closely over cross span 9. Projecting outwardly, and then downwardly, from two opposite edges of the cap are shield sides each having a web 16, a side wall 17, a free-standing columnar projection 18 and an inclined flange 19. Webs 16 extend a top face of the cap 14 to the width of flange 7. Side walls 17 contact the edge of flange 7 and screen a major part of the transformer wire on two sides, a major part of the transformer wire on the other two sides being screened by the laminations 8.

On assembly, the inclined flange 19 integral with the bottom edge of each side wall 17, covers the input and output transformer wire lengths 12. Each projection 18 lies in the plane of its neighbouring side wall 17 and extends upwardly from one end of respective flanges 19, the two projections 18 being at diametrically opposite sides of a shield. When in place, an upper tip of each projection 18 locates under and hard by a corner of the flange 7; projecting from an inner surface of the tip is a ramp 20.

To attach the shield 13, it is hand guided to a horizontal orientation resembling that of FIG. 4 and then pressed downwardly into place over the transformer 2. The ramps 20 initially function as camming surfaces to deflect the tips of projections 18 outwardly. This allows the shield to be pushed down at a position determined by the fit of cross span 9 in cap 14. Then, when the shield is in place, the natural resilience of the projections 18 restores the tips to their rest position under the flange 7; in this position they function to lock the shield against inadvertent removal.

In order, deliberately, to detach the shield, for example, during repair, the repairer hooks a thumb tip between the laminations 8 and the most accessible projection 18 and outwardly deflects the projection to release it from its locking engagement with the flange 7. As the ramp 20 is released, the cap 14 lifts slightly away from the cross span 9 to allow the shield to be easily manipulated to release the other ramp 20. In fact, we have determined that in the embodiment illustrated, sufficient spring energy is stored in the shield as one projection 18 is being release, that the shield 13 recoils completely from the transformer 2.

In an alternative embodiment, (not shown) the columnar projection 18 is integral with its neighbouring sidewall 17 and the whole side is torsionally flexed as the shield is pressed down onto the transformer.

What is claimed is:

1. A transformer and shield assembly comprising a transformer mounted on a baseboard, the transformer including coils wound on a bobbin, the bobbin having a central former extending between first and second bobbin flanges, electrical input and output wires of said coils passing adjacent said first bobbin flange, and a shield of one-piece construction having a cap, at least one wall depending from a part at least of the cap perimeter, a protective flange projecting outwardly from a distal edge of said wall, and fixture means for demountably mounting the shield at the second bobbin flange, the fixture means including a part spring deflectable from a position seated under said second flange thereby to demount the shield wherein, with said shield mounted, said wall at least partially covers transformer coil wire on said former, said protective flange at least partially covers the transformer coil input and output wire, and the part of the baseboard surrounding the transformer and shield assembly remains exposed.

2. An assembly as claimed in claim 1, wherein the bobbin flanges and former are both substantially rectangular.

3. An assembly as claimed in claim 2, wherein two such walls depending from the cap are in opposed disposition and at least partially cover opposite sides of the bobbin.

4. An assembly as claimed in claim 3, wherein the transformer includes a stack of laminations extending adjacent an outer surface of the second bobbin flange and said cap has a surface configured to fit closely around said laminations.

5. An assembly as claimed in claim 4, wherein said fixture means comprises a columnar projection extending from said protective flange said projection being spring deflectable from a position in which a free end of the columnar formation is seated under said second flange thereby to demount the shield.

6. An assembly as claimed in claim 5, wherein said free end is formed within an inwardly projecting lug.

7. an assembly as claimed in claim 6, wherein the lug is ramp-shaped.

8. An assembly as claimed in claim 1, wherein the shield is moulded in ABS plastic.

* * * * *